US006876267B2

(12) United States Patent
Komai et al.

(10) Patent No.: US 6,876,267 B2
(45) Date of Patent: Apr. 5, 2005

(54) NONRECIPROCAL CIRCUIT DEVICE

(75) Inventors: Eiichi Komai, Niigata-ken (JP); Hitoshi Onishi, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 7 days.

(21) Appl. No.: 10/281,702

(22) Filed: Oct. 28, 2002

(65) Prior Publication Data

US 2003/0080823 A1 May 1, 2003

(30) Foreign Application Priority Data

Oct. 29, 2001 (JP) ..... 2001-331292

(51) Int. Cl.[7] ..... H01P 1/38; H01P 1/387
(52) U.S. Cl. ..... 333/1.1; 333/24.2
(58) Field of Search ..... 333/1.1, 24.2

(56) References Cited

FOREIGN PATENT DOCUMENTS

| | | | |
|---|---|---|---|
| DE | 100 11 174 A | | 10/2000 |
| EP | 0 903 801 A | | 3/1999 |
| JP | 2000-261210 | | 9/2000 |
| JP | 2001127505 A | * | 5/2001 |
| JP | 2001168604 A | * | 6/2001 |

* cited by examiner

*Primary Examiner*—Stephen E. Jones
(74) *Attorney, Agent, or Firm*—Brinks Hofer Gilson & Lione

(57) ABSTRACT

In a nonreciprocal circuit device, receiving surfaces for bending first and second line conductors are formed at the respective ends of the confronting two sides of a magnetic substrate, the first and second line conductors are bent to the other surface of the magnetic substrate through the receiving surfaces thereof as well as disposed on the other surface of the magnetic substrate along the diagonal lines.

13 Claims, 10 Drawing Sheets

NONRECIPROCAL CIRCUIT DEVICE

BACKGROUND OF THE INVENTION

1. Field of the Invention

The present invention relates to a nonreciprocal circuit device such as an isolator and a circulator used in a high frequency band such as a microwave band.

2. Description of the Related Art

This type of the nonreciprocal circuit device includes a magnetic assembly 50 having a structure shown in, for example, FIG. 13. The magnetic assembly 50 is composed of a magnetic body 55 composed of a rectangular plate-shaped ferrite, a common electrode 54 composed of a metal plate and disposed on the lower surface of the magnetic body 55, and a first central conductor 51, a second central conductor 52, and a third central conductor 53 which extend radially from the common electrode 54 in three directions and are wound on the front surface side of the magnetic body 55.

The first, second, and third central conductors 51, 52, and 53 are bent along the magnetic body 55 and overlapped each other at an intersecting angle of about 120° on the front surface of the magnetic body 55. Note that, while omitted in the figure, the central conductors 51, 52, and 53 are individually insulated from each other by insulation sheets on the front surface of the magnetic body 55.

Further, each of three central conductors 51, 52, and 53 is disposed such that the extreme end thereof extends from a side of the magnetic body 55, and the extreme ends of the central conductors 51, 52, and 53 are arranged as respective ports P1, P2, and P3. Then, the nonreciprocal circuit device is arranged such that a not shown matching capacitor is connected to each of the ports P1, P2, and P3, a terminal resistor is connected to one of the ports through the capacitor, and they are accommodated in a magnetic yoke, which constitutes a magnetic circuit, together with a permanent magnet so that a DC magnetic field can be applied to the magnetic assembly 50 by a permanent magnet disposed separately.

As shown in a developed view of FIG. 14, the respective central conductors 51–53 are mutually connected and integrated at the common electrode 54 acting as a ground portion and extend from the common electrode 54 in the three directions. These central conductors 51 to 53 are bent at the positions of bending portions X shown in FIG. 14 so that they are accurately assembled to the magnetic body 55 at predetermined angles.

In the nonreciprocal circuit device having the conventional arrangement, the accuracy with which the central conductors 51–53 are assembled to the magnetic body 55, the intervals between the conductors, and the intersecting angles of the central conductors are important factors for determining the electric characteristics of the nonreciprocal circuit device, and even a slight variation of the values of them from designed values deteriorates the performance of the nonreciprocal circuit device.

In particular, this type of the nonreciprocal circuit device has an overall size of a 4 to 5 mm square to cope with the recent miniaturization of a high frequency circuit. However, it is very difficult in the magnetic assembly 50 having the structure shown in FIG. 13 to strictly adjust the assembling accuracy of the central conductors 51 to 53 to the magnetic body 55, the intervals between the conductors, and the intersecting angles in such a minute part.

For example, in the magnetic assembly 50 having the conventional arrangement, the central conductors 51 to 53 must be disposed on the magnetic body 55 by being accurately bent at the positions of the bending portions X shown in FIG. 14 along the sides of the magnetic body 55. However, even a slight dislocation of the positions of the bending portions X of the central conductors 51 to 53 in the isolator having the overall size of the 4 to 5 mm square greatly varies the intersecting angles of the central conductors 51 to 53 that intersect on the front surface of the magnetic body 55. Further, the bending portions X of the central conductors 51 to 53 must be accurately aligned along the edges of the sides of the magnetic body 55 and carefully bent, which deteriorates workability when the magnetic assembly 50 is assembled.

SUMMARY OF THE INVENTION

An object of the present invention, which was made based on the above background, is to obtain a magnetic assembly by accurately and easily winding central conductors around a magnetic body to thereby provide a nonreciprocal circuit device having excellent characteristics.

Further, an object of the present invention is to provide a nonreciprocal circuit device that is miniaturized by effectively disposing capacitor substrates adjacent to a magnetic substrate which has s substantially rectangular shape, in the longitudinal direction thereof.

To solve the above problems, according to the present invention, a nonreciprocal circuit device includes a magnetic substrate which has a substantially rectangular shape, when viewed in a plane, partitioned by two confronting straight sides and at least one side connecting the respective ends of the two sides, a plate-shaped common electrode disposed on one surface of the magnetic substrate, a first line conductor, a second line conductor, and a third line conductor extending from the outer periphery of the common electrode in three directions, a first central conductor disposed to the first line conductor and bent to the other surface side of the magnetic substrate, a second central conductor disposed to the second line conductor and bent to the other surface side of the magnetic substrate, and a third central conductor disposed to the third line conductor and bent to the other surface side of the magnetic substrate, wherein receiving surfaces for bending the respective central conductors are formed at the respective ends of the two confronting sides of the magnetic substrate, and the first central conductor and the second central conductor are bent to the other surface side of the magnetic substrate through the receiving surfaces of the magnetic substrate as well as disposed along the diagonal lines of the magnetic substrate on the other surface thereof.

Since the first and second central conductors are bent and wound from one surface to the other surface of the magnetic substrate through the receiving surfaces thereof, the central conductors can be wound to the other surface of the magnetic substrate by being reliably bent at accurate positions through the receiving surfaces. As a result, the central conductors can be disposed to the magnetic substrate at reliable positions. That is, as a result of bending the central conductors through the edges of the receiving surfaces, a deformation caused when the central conductors are bent is suppressed, thereby the respective central conductors are bent with respect to the magnetic substrate at predetermined angles.

Accordingly, since the nonreciprocal circuit device having excellent characteristics and stable and high quality is obtained, thereby the productivity of an assembling job of the nonreciprocal circuit device is improved.

To solve the above problems, according to the present invention, a nonreciprocal circuit device includes a magnetic substrate which has a substantially rectangular shape, when viewed in a plane, having a shape partitioned by two confronting straight sides and at least one side connecting the respective ends of the two sides, a plate-shaped common electrode disposed on one surface of the magnetic substrate, a first line conductor, a second line conductor, and a third line conductor extending from the outer periphery of the common electrode in three directions, a first central conductor disposed to the first line conductor and bent to the other surface side of the magnetic substrate, a second central conductor disposed to the second line conductor and bent to the other surface side of the magnetic substrate, and a third central conductor disposed to the third line conductor and bent to the other surface side of the magnetic substrate, wherein capacitor substrates connected to the line conductors are disposed on both the sides of the magnetic substrate which has a substantially rectangular shape, when viewed in a plane, in the width direction thereof along the longer direction thereof.

When the capacitor substrates are disposed on both the sides of the magnetic substrate along the longer direction thereof, they can be disposed on both the sides of the magnetic substrate in a good settlement. As a result, the nonreciprocal circuit device including the magnetic substrate and the capacitor substrates can be miniaturized in its entirety. When the capacitor substrates have a slender shape, even if they are disposed on both the sides of the magnetic substrate having a long shape, the width of the nonreciprocal circuit device is not unnecessarily increased in its entirety, thereby the miniaturization of the nonreciprocal circuit device can be realized.

To solve the above problems, according to the nonreciprocal circuit device of the present invention, recessed portions are formed on both the sides of at least one of the portion where the first line conductor is connected to the common electrode, the portion where the second line conductor is connected to the common electrode, and the portion where the third line conductor is connected to the common electrode by cutting the peripheral edge of the common electrode so that the length of at least one of the line conductors extends.

The apparent lengths of the line conductors can be increased by forming the recessed portions by cutting the peripheral edge of the common electrode at the positions thereof corresponding to the bases of the line conductors. The increase in the length of the line conductors increases the inductances of the line conductors and relatively reduces a resonant capacitance, which contributes to the miniaturization of the nonreciprocal circuit device. Further, the area of the magnetic substrate can be reduced when the same inductance is secured, which also contributes to the miniaturization of the overall nonreciprocal circuit device.

To solve the above problems, according to the nonreciprocal circuit device of the present invention, slits are formed at the center of the first line conductor in the width direction thereof and at the center of the second line conductor in the width direction thereof along the length directions thereof so that each of the first line conductor and the second line conductor are divided into two divided conductors.

A mutual inductance is generated by the division of each line conductor into the two divided conductors. Thus, even if the line conductor has the same length, a larger inductance can be obtained by dividing it.

To solve the above problems, according to the nonreciprocal circuit device of the present invention, the divided conductors are bent to the other surface side of the magnetic substrate and overlapped on the other surface of the common electrode, and the portions where the respective divided conductors are overlapped are dislocated on the other surface of the common electrode when viewed in a plane.

Since the portions, where the divided conductors are overlapped, are dislocated when viewed in a plane, the divided conductors can be uniformly disposed on the other surface of the magnetic substrate in a good settlement.

To solve the above problems, according to the nonreciprocal circuit device of the present invention, the third central conductor is overlapped on the first central conductor and the second central conductor on the other surface of the magnetic substrate, when viewed in a plane, and all the portions where the third central conductor is overlapped on the first central conductor and the second central conductor are dislocated when viewed in a plane.

There is no portion where three divided conductors are overlapped. Thus, the occurrence of irregularities, which are caused by the occurrence of portions where two divided conductors are overlapped and portions where three divided conductors are overlapped, is reduced, thereby irregularities on the other surface of the magnetic substrate are reduced.

To solve the above problems, according to the nonreciprocal circuit device of the present invention, the third central conductor is bent or curved so as to intersect the first central conductor and the second central conductor and to be overlapped thereon, when viewed in a plane, on the other surface of the magnetic substrate and is divided into two divided conductors which include non-parallel portions.

Further, according to the nonreciprocal circuit device of the present invention, the third central conductor is bent or curved so as to intersect the first central conductor and the second central conductor and to be overlapped thereon, when viewed in a plane, on the other surface of the magnetic substrate and divided into two divided conductors which are bent or curved in a parallel state.

Since the divided conductors of the third line conductor include the portions which are in parallel with each other, the length of the third line conductor overlapped with the magnetic substrate is substantially increased, thereby the nonreciprocal circuit device having broad band pass characteristics is provided. Further, an inductance must be increased by increasing the lengths of the respective line conductors to realize the low frequency. In the present invention, the third central conductor of the third line conductor is bent (flexed) or curved in a direction where it is separated from each other at the central portion thereof in a length direction or disposed in parallel with each other and bent or curved so as to increase the inductance of the third line conductor by substantially increasing the length of the third line conductor, which permits the low frequency to be compatible with the miniaturization.

To solve the above problems, according to the nonreciprocal circuit device of the present invention, at least one of the capacitor substrates is arranged as a common capacitor substrate connected to the plurality of line conductors.

A necessary capacitance can be obtained by a small capacitor occupying area by the provision of the common capacitor substrate.

To solve the above problems, according to the nonreciprocal circuit device of the present invention, the magnetic substrate has an approximately rectangular shape when viewed in a plane, including slant receiving surfaces at the respective ends of the two confronting sides.

Since the magnetic substrate having the approximately rectangular shape, when viewed in a plane, includes the slant receiving surfaces, the central conductors can be reliably bent at accurate positions through the receiving surfaces and wound to the other surface of the magnetic substrate. As a result, the central conductors can be disposed to the magnetic substrate at reliable positions. That is, as a result of reliably bending the central conductors through the edges of the receiving surfaces, a deformation caused when the central conductors are bent is suppressed, thereby the respective central conductors can be bent with respect to the magnetic substrate at the predetermined angles.

Accordingly, since the nonreciprocal circuit device having excellent characteristics and stable and high quality is obtained, thereby the productivity of the assembling job of the nonreciprocal circuit device is improved.

To solve the above problems, according to the nonreciprocal circuit device of the present invention, the common electrode has a shape partitioned by two confronting sides and at least one side connecting the respective ends of the two sides and disposed on the one surface of the magnetic substrate with at least a portion of the peripheral edge thereof disposed along the peripheral edge of the magnetic substrate.

The common electrode can be disposed on the one surface of the magnetic substrate in a good settlement by forming a part of the shape of the common electrode in a shape near to that of the magnetic substrate.

To solve the above problems, according to the nonreciprocal circuit device of the present invention, the common electrode has an approximately rectangular shape, when viewed in a plane, having slant side portions at the respective ends of the two confronting sides and has such a size as to be disposed on the one surface of the magnetic substrate with the peripheral edge thereof disposed along the peripheral edge of the magnetic substrate.

The common electrode can be disposed on the one surface of the magnetic substrate in a good settlement by forming the overall shape of the common electrode in a shape near to that of the magnetic substrate.

To solve the above problems, the isolator of the present invention is a nonreciprocal circuit device provided with the nonreciprocal circuit device according to any of the aspects described above.

Accordingly, the isolator including the nonreciprocal circuit device having various characteristics described above can be provided.

To solve the above problems, the isolator of the present invention is a nonreciprocal circuit device arranged such that capacitor substrates are connected to the first line conductor, the second line conductor, and the third line conductor according to any of the aspects described above, a resistor element is connected to one of the three line conductors, and the magnetic substrate, the line conductors, and the capacitor substrates are accommodated in a case member.

DESCRIPTION OF THE PREFERRED EMBODIMENTS

Figure 1A:
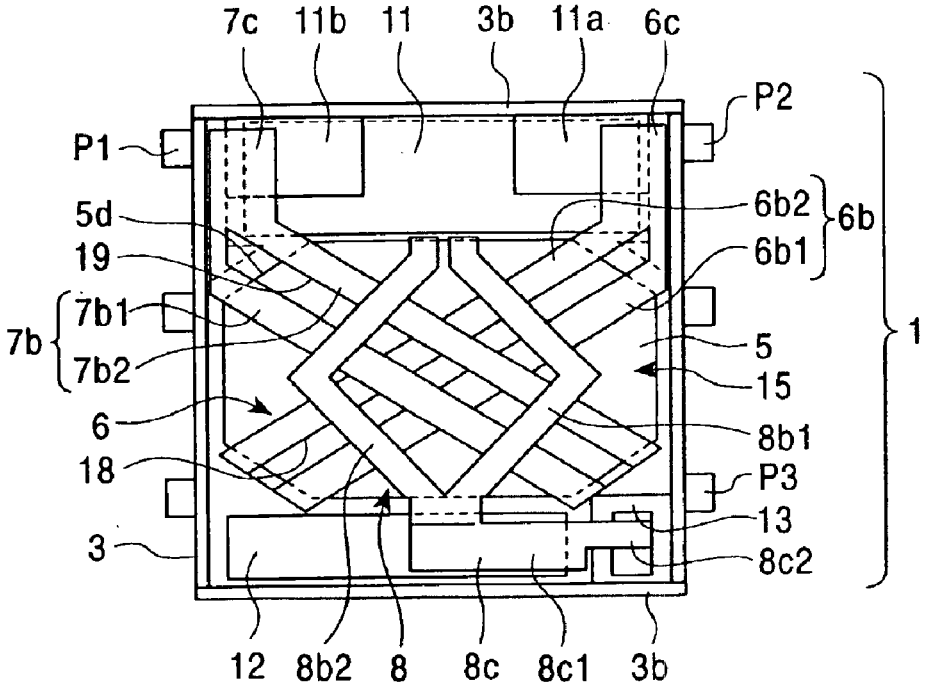
FIG. 1A is a plan view of an isolator, from which a part thereof is removed, according to a first embodiment of the present invention.

The present invention will be described below in more detail. In the following embodiments, examples of an isolator of a nonreciprocal circuit device will be explained.

FIG. 1–FIG. 6 show a first embodiment of a nonreciprocal circuit device according to the present invention. An isolator 1 of the embodiment includes a magnetic member 4 composed of a permanent magnet, and the like for applying a DC bias magnetic field in a direction vertical to a surface of a magnetic substrate 5 composed of a ferromagnetic substance, the magnetic substrate 5, line conductors 6, 7, and 8, a common electrode 10 to which the line conductors 6, 7, and 8 are connected, capacitor substrates 11 and 12 disposed on both the sides of the magnetic substrate 5 and acting as matching capacitors to first, second, and third extreme end conductors 6*c*, 7*c*, and 8*c*, and a terminating resistor 13, and these components are disposed in a closed magnetic circuit composed of upper and lower yokes 2 and 3.

Figure 4A:
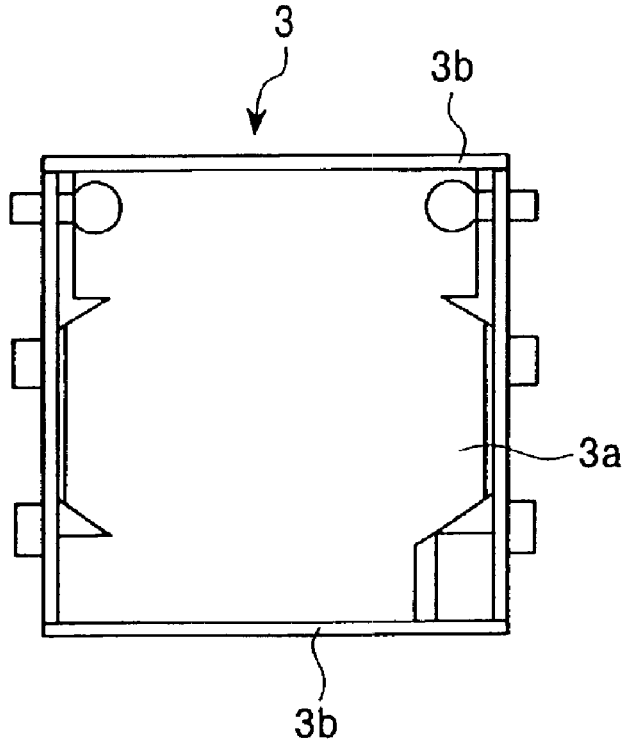
FIG. 4A is a plan view showing a lower yoke of the isolator according to the present invention.
Figure 4B:
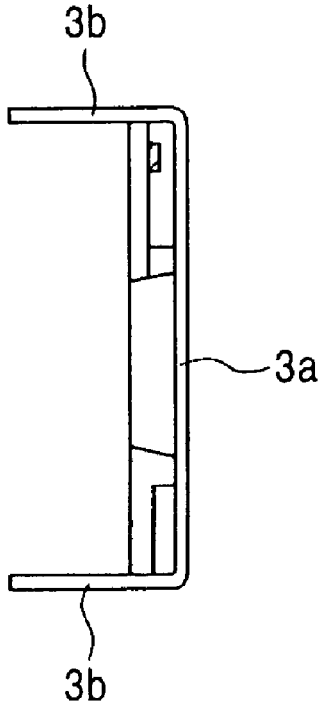
FIG. 4B is a side elevational view of the lower yoke.
Figure 5:
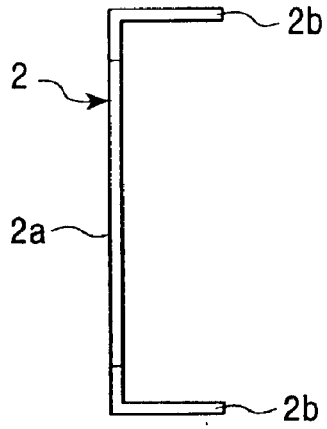
FIG. 5 is a side elevational view showing an upper yoke of the isolator.

The upper and lower yokes 2 and 3 are composed of a ferromagnetic substance such as soft iron, and the like and have a square box shape as shown in FIGS. 4 and 5. Note that it is preferable to form a conductive layer such as Ag plating, and the like on the front and back surfaces of the yokes. Further, the upper yoke 2 having an approximate C-shape when viewed in a side has such a size as to be fitted in the lower yoke 3 having an approximate C-shape when viewed in a side so that the box-shaped closed magnetic circuit can be arranged by integrating the upper yoke 2 with the lower yoke 3 by fitting the openings of thereof to each other.

That is, as shown in FIG. 4, the lower yoke 3 is composed of a bottom plate 3*a* having a rectangular shape when viewed in a plane and side walls 3*b* standing on the confronting two sides of the bottom plate 3*a*, and has a C-shape when viewed in a side. Whereas, as shown in FIG. 5, the upper yoke 2 is composed of a top plate 2*a* having a rectangular shape when viewed in a plane and side walls 2*b* standing on the confronting two sides of the top plate 2*a*, and has a C-shape when viewed in a side. Then, the box-shaped closed magnetic circuit is arranged by alternately disposing the side walls 2*b*, 2*b* of the upper yoke 2 and the side walls 3*b*, 3*b* of the lower yoke 3 so as to fit the upper yoke 2 to the lower yoke 3. Note that the shape of the yokes 2 and 3 are not limited to the C-shape as in the embodiment and may have any arbitrary shape as long as the box-shaped closed magnetic circuit is composed of a plurality of yokes.

A magnetic assembly 15, which is composed of the magnetic substrate 5, the three line conductors 6, 7, and 8 and the common electrode 10 to which the line conductors 6, 7, and 8 are connected, is accommodated in a space surrounded by the upper and lower yokes 2 and 3 fitted to each other as described above, in other words, in the closed magnetic circuit composed of the upper and lower yokes 2 and 3.

Figure 2:
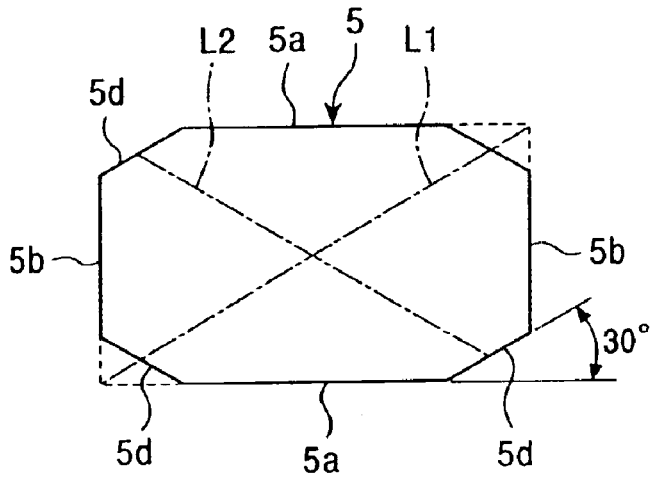
FIG. 2 is a plan view showing an example of a magnetic substrate used in the isolator according to the present invention.

The magnetic substrate 5 is composed of a ferromagnetic substance such as ferrite, and the like, and has a substantially rectangular plate shape when viewed in a plane as shown in FIG. 2. More specifically, the magnetic substrate 5 has the substantially rectangular plate shape when viewed in a plane by being composed of two confronting laterally long sides 5*a*, 5*a*, short sides 5*b*, 5*b* perpendicular to the long sides 5*a*, 5*a*, and four slant sides 5*d* located at both the ends of the long sides 5*a*, 5*a*, slanting at 150° with respect to the respective long sides 5*a* (slanting at 30° with respect to lines extending from the long sides 5*a*) and connected to the short sides 5*b*, respectively. Thus, slant surfaces (receiving surfaces) 5*d*, which slant at 150° with respect to the long sides 5*a* (slant at 130° with respect to the short sides 5*b*), respectively are formed at the four corners of the magnetic substrate 5 when viewed in a plane.

Further, in the magnetic substrate 5, it is preferable that the ratio between the width thereof in a transverse direction, that is, in a longer direction and the width thereof in a longitudinal direction, that is, in a direction perpendicular to the longer direction, that is, the aspect ratio thereof be within the range equal to or larger than 25% (1:4) and equal to or less than 80% (4:5), that is, it is preferable that the magnetic substrate 5 has a substantially rectangular shape when viewed in a plane.

Note that while what is shown in FIG. 1 is the magnetic substrate 5 having a width-long shape when viewed in a plane, when FIG. 1 is viewed sideways by turning it 90°, the magnetic substrate 5 has a length-long shape. Accordingly, the present invention considers that the magnetic substrate 5 is definitely equivalent even if it has a width-long shape or a portrait shape.

Figure 3:
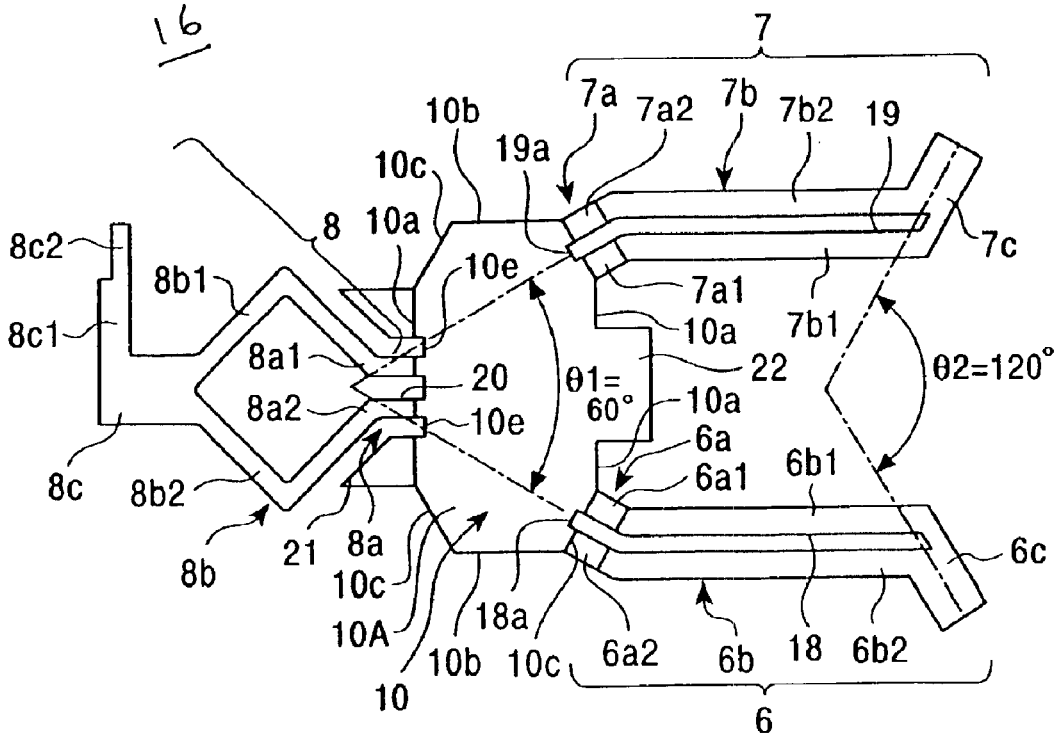
FIG. 3 is a developed view of an electrode used in the isolator according to the present invention.

As shown in a developed view of FIG. 3, the three line conductors 6, 7, and 8 are integrated with the common electrode 10, and an electrode 16 is mainly composed of the three line conductors 6, 7, and 8 and the common electrode 10. The common electrode 10 is composed of a main body 10A composed of a metal plate having an approximately similar figure as that of the magnetic substrate 5 when viewed in a plane. That is, the main body 10A has an approximately rectangular shape (oblong shape) when viewed in a plane and is composed of two confronting long sides 10*a*, 10*a*, short sides 10*b*, 10*b* perpendicular to the two long sides 10*a*, 10*a*, and four slant portions 10*c* located at both the ends of the two long sides 10*a*, 10*a*, slanting at 150° with respect to the respective long sides 10*a*, and connected to the short sides 10*b* at slanting angle angles of 130°.

Then, the first line conductor 6 and the second line conductor 7 extend from the two slant portions 10*c* of one of the long sides of the slant portions 10*c* located at the four corners of the common electrode 10. First, the first line conductor 6, which is composed of a first base conductor 6*a*, a first central conductor 6*b*, and the first extreme end conductor 6*c*, extends from one of the two slant portions 10*c*, whereas the second line conductor 7, which is composed of a second base conductor 7*a*, a second central conductor 7*b*, and the second extreme end conductor 7*c*, extends from the other of the two slant portions 10*c*. The base conductors 6*a* and 7*a* have the same width as that of the slant portions 10*c* so that they extend from the slant portions 10*c*. The base conductors 6*a* and 7*a* are arranged such that the center axes thereof slant at slanting angles of 150° with respect to the long sides 10*a* of the common electrode 10. Next, the central conductors 6*b* and 7*b* are in parallel with the short sides 10*b* of the common electrode 10, in other words, has slant angles of 150° with respect to the center axes (length direction) of the base conductors 6*a* and 7*a*, and further the extreme end conductors 6*c* and 7*c* slant at 150° with respect to the long sides 10*a* of the common electrode 10.

From the above arrangement, the angle θ1 between the center axes of the base conductors 6*a*, 7*a* is set to 60° as shown in FIG. 3, whereas the angle θ2 between the center axes of the extreme end conductors 6*c* and 7*c* is set to 120° as shown in FIG. 3.

Next, a slit 18 is formed to the first line conductor 6 at the center thereof in a width direction and reaches the base end of the extreme end conductor 6*c* passing through the base conductor 6*a* and the central conductor 6*b* from the outer periphery of the common electrode 10. The central conductor 6*b* is divided into two divided conductors 6*b*1 and 6*b*2 by the formation of the slit 18, and the base conductor 6*a* is also divided into two divided conductors 6*a*1 and 6*a*2. A similar slit 19 is also formed to the second line conductor 7 at the center thereof in a width direction, the central conductor 7*b* is divided into two divided conductors 7*b*1 and 7*b*2 by the formation of the slit 19, and the base conductor 7*a* is also divided into two divided conductors 7*a*1 and 7*a*2.

The end of the slit 18 on the common electrode 10 side thereof passes through the connection conductor 6*a* and reaches a slightly deep position of the common electrode 10 from the outer periphery thereof to thereby form a recessed portion 18*a* so that the length of the first line conductor 6 is slightly increased. Further, the end of the slit 19 on the common electrode 10 side thereof also passes through the connection conductor 7*a* and reaches the outer periphery of the common electrode 10 to thereby form a recessed portion 19*a* so that the length of the second line conductor 7 is slightly increased. Note that the recessed portions 18*a* and 19*a* may be or may not be provided appropriately, as necessary.

In contrast, the third line conductor 8 extends from the other long side 10*a* of the common electrode 10 at the center thereof. The third line conductor 8 is composed of a third base conductor 8*a* extending from the common electrode 10, a third central conductor 8*b*, and the third extreme end conductor 8*c*. The third base conductor 8*a* is composed of two strip-shaped divided conductors 8*a*1 and 8*a*2 extending from the long side of the common electrode 10 at the center thereof at approximately right angles, and a slit 20 is formed between the two divided conductors 8*a*1 and 8*a*2. The third central conductor 8*b* is composed of a divided conductors 8*b*1 and 8*b*2, the divided conductor 8*b*1 being connected to the divided conductor 8*a*1 and having an L-shape when viewed in a plane, and the divided conductor 8*b*2 being connected to the divided conductor 8*a*2 and having an L-shape when viewed in a plane. The divided conductor 8*b*1 and the divided conductor 8*b*2 extend from the divided conductor 8*a*1 and the divided conductor 8*a*2 with the central portions thereof separated from each other so that the substantial conductor lengths of the divided conductors 8*b*1 and 8*b*2 are increased, and the central conductor 8*b* is formed in a rhombic shape by the divided conductors 8*b*1 and 8*b*2.

Further, the extreme ends of the divided conductors 8*b*1 and 8*b*2 are integrated with the third L-shaped extreme end conductor 8*c*. The third extreme end conductor 8*c* is composed of a connecting portion 8*c*1, which integrates the divided conductor 8*b*1 with the divided conductor 8*b*2 and extends in the same direction as that of the divided conductors 8*a*1 and 8*a*2, and a connecting portion 8*c*2 which extends in a direction approximately perpendicular to the connecting portion 8*c*1.

Next, three recessed portions 10*e* are formed, as necessary, on both the sides of the divided conductors 8*a*1 and 8*a*2 of the third line conductor 8 on the other long side 10*a* of the common electrode 10 by partly cutting out the long side 1*a*. The length of the third line conductor 8 is slightly increased by forming the recessed portions 10*e*. Further, trapezoidal support pieces 21 extend from the outsides of the two recessed portions 10*e* located on the both sides the three recessed portions 10*e* at the other long side 10*a* of the common electrode 10, in other words, from between the recessed portions 10*e* and the slant portions 10*c* in a direction parallel with the divided conductors 8*a*1 and 8*a*2. Further, a support piece 22, which has a rectangular shape when viewed in a plane, also extends from the one of the long sides 10*a* of the common electrode 10 at the center thereof. These support pieces 21 and 22 are arranged as the ground electrodes of the capacitor substrates 11 and 12 and electrically connected to one surfaces of the capacitor substrates 11 and 12, and the other surfaces of the capacitor substrates 11 and 12 are electrically connected to the respective extreme end conductors 6*c*, 7*c*, and 8*c* as described later. Note that the ground electrodes of the capacitor substrates 11 and 12 may be directly connected to the bottom plate 3*a* of the lower yoke 3 without using the support pieces 21 and 22. Further, the capacitor substrate 11 may be formed integrally or separately.

The common electrode 10 arranged as described above is mounted on the magnetic substrate 5 by causing the main body 10A thereof to come into intimate contact with the back surface (one surface) of the magnetic substrate 5 and by bending the first, second, and third line conductors 6, 7, and 8 to the front surface side (the other surface side) of the magnetic substrate 5 to thereby constitute the magnetic assembly 15 together with the magnetic substrate 5. That is, the magnetic assembly 15 is constructed by mounting the common electrode 10 on the magnetic substrate 5 in such a manner that the divided conductors 6*a*1 and 6*a*2 of the first line conductor 6 are bent along the edge of one of the slant surfaces 5*d* of the magnetic substrate 5, the divided conductors 7*a*1 and 7*a*2 of the second line conductor 7 are bent along another one of the slant surfaces 5*d* of the magnetic substrate 5, the divided conductors 8*a*1 and 8*a*2 of the third line conductor 8 are bent along the edge of a long side 5*a* of the magnetic substrate 5, the central conductor 6*a* of the first line conductor 6 is disposed on the front surface (the other surface) of the magnetic substrate 5 along a diagonal line on the front surface thereof, the central conductor 7*b* of the second line conductor 7 is disposed on the front surface (the other surface) of the magnetic substrate 5 along a diagonal line on the front surface thereof, and further the central conductor 8*b* of the third line conductor 8 is disposed on the front surface of the magnetic substrate 5 along the central portion thereof.

Note that when the magnetic substrate 5 is viewed in a plane as shown in FIG. 2 and it is assumed that the positions, at which the lines extending from the respective long sides 5*a* and the respective short sides 5*b* intersect with each other, are the apexes of the magnetic substrate 5 having an approximately rectangular shape when viewed in a plane, the diagonal lines described here are defined as line segments connecting the confronting apexes of the four apexes and denoted by L1 and L2.

Further, while the divided conductors 8*b*1 and 8*b*2 are disposed on the front surface of the magnetic substrate 5, it is preferable that the length of the divided conductor 8*b*1 or the divided conductor 8*b*2, which is disposed in contact with the front surface of the magnetic substrate 5, be 105% or more of the longitudinal width of the magnetic substrate 5 shown in FIG. 2 (the width of the landscape rectangular magnetic substrate 5 along the width direction thereof). With this arrangement, it is possible to make the low frequency of the nonreciprocal circuit device compatible with the miniaturization thereof by increasing the substantial length of the divided conductors 8*b*1 and 8*b*2.

As described above, the first and second line conductors 6 and 7 are overlapped and disposed on the magnetic substrate 5 along the diagonal lines L1 and L2 thereof, respectively as shown in FIG. 1A by mounting the first to third line conductors 6, 7, and 8 on the front surface of the magnetic substrate 5, and the first and second central conductors 6*b* and 7*b* are overlapped on the front surface of the magnetic substrate 5 by interesting with each other at a slant angle of 120° when viewed in a plane. Further, in the state in which the first to third central conductors 6*b*, 7*b*, and 8*b* are overlapped, all the portions where the divided conductors 6*b*1 and 6*b*2 of the first central conductor 6*b* are overlapped with the divided conductors 7*b*1 and 7*b*2 of the second central conductor 7*b* are dislocated from each other on the front surface side of the magnetic substrate 5 when viewed in a plane, thereby the portions where the divided conductors 6*b*1 and 6*b*2 are overlapped with the divided conductors 7*b*1 and 7*b*2 are disposed on the front surface of the magnetic substrate 5 so that they are not overlapped with each other thereon.

Further, the divided conductors 8*b*1 and 8*b*2 of the third central conductor 8*b* are disposed to get away from the portions where the divided conductors 6*b*1 and 6*b*2 are overlapped with the divided conductors 7*b*1 and 7*b*2. Accordingly, in the combinations of the divided conductors 6*b*1 and 6*b*2, the divided conductors 7*b*1 and 7*b*2, and the divided conductors 8*b*1 and 8*b*2 disposed on the front surface of the magnetic substrate 5, they are disposed such that three of them are not overlapped with each other even if two of them are overlapped with each other.

Figure 1B:
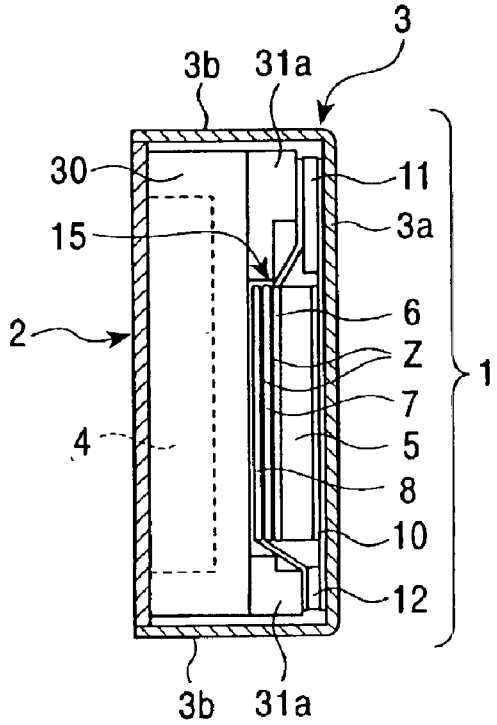
FIG. 1B is a sectional view of the isolator.

Note that while omitted in FIG. 1A, the respective line conductors 6, 7, and 8 are electrically insulated from each other by interposing insulating sheets Z between the magnetic substrate 5, the first line conductor 6, the second line conductor 7, and the third line conductor 8 as simply shown in FIG. 1B.

Next, the magnetic assembly 15 is disposed on the bottom of the lower yoke 3 at the center thereof, and the plate-shaped capacitor substrates 11 and 12, which have a slender shape when viewed in a plane and about half as thick as the magnetic substrate 5, are accommodated in the lower yoke 3 on both the sides of the magnetic assembly 15 disposed on the bottom thereof, and the terminating resistor 13 is accommodated on one of the sides of the capacitor substrate 12. More specifically, the length of the magnetic substrate 5 of the magnetic assembly 15 is substantially as long as the inner width of the lower yoke 3, and the width of the magnetic substrate 5 (width in a direction perpendicular to a longer direction) is smaller than the inner width of the lower yoke 3. Thus, spaces capable of accommodating the capacitor substrates 11 and 12 are formed on both the sides of the magnetic substrate 5 in the width direction thereof as shown in FIG. 1 in the state in which the magnetic substrate 5 is accommodated width-long direction in the lower yoke 3 when viewed in a plane as shown in FIG. 1, and the capacitor substrates 11 and 12 and the terminating resistor 13 are accommodated in the spaces.

Then, the capacitor substrates 11 and 12 and the terminating resistor 13 are connected to the magnetic assembly 15 by electrically connecting the extreme end conductor 6*c* of the first line conductor 6 to an electrode 11*a* formed to the end of one of the sides of the capacitor substrate 11, electrically connecting the extreme end conductor 7*c* of the second line conductor 7 to an electrode 11*b* formed to the end of the other side of the capacitor substrate 11, and electrically connecting the extreme end conductor 8*c* of the third line conductor 8 to the capacitor substrate 12 and to the terminating resistor 13. Note that when the terminating resistor 13 is not connected, the magnetic assembly 15 acts as a circulator.

The first port P1 acting as the nonreciprocal circuit device 1 is formed at the end of the capacitor substrate 11 to which the portion of the extreme end conductor 7*c* is connected, the second port P2 acting as the nonreciprocal circuit device 1 is formed at the end of the capacitor substrate 11 to which the portion of the extreme end conductor 6*c* is connected, and the end of the terminating resistor 13 to which the portion of the extreme end conductor 8*c* is connected is arranged as the third port P3 of the nonreciprocal circuit device 1.

In the isolator 1 of the embodiment, it is preferable that the length the longer side of the capacitor substrate 11, which is in a direction in parallel with the direction along the first port P1 and the second port P2, be set equal to or larger than 65% to equal to or less than 100% of the length of the longer side of the overall isolator 1 in the direction (in other words, of the length of the lower yoke 3 in the direction). It is more preferable that the length of the longer side of the capacitor substrate 11 be set equal to or larger than 75% to equal to or less than 100% of the length within the above range.

Next, in a direction perpendicular to the direction along the port P1 and the port P2, it is preferable that the width of the capacitor substrate 11 be equal to or larger than 15% to equal to or less than 45% of the length of the overall nonreciprocal circuit device 1 in the direction (in other words, of the length of the lower yoke 3 in the direction). It is more preferable that the width of the capacitor substrate 11 be equal to or larger than 30% to equal to or less than 45% of the length within the above range.

Figure 6:
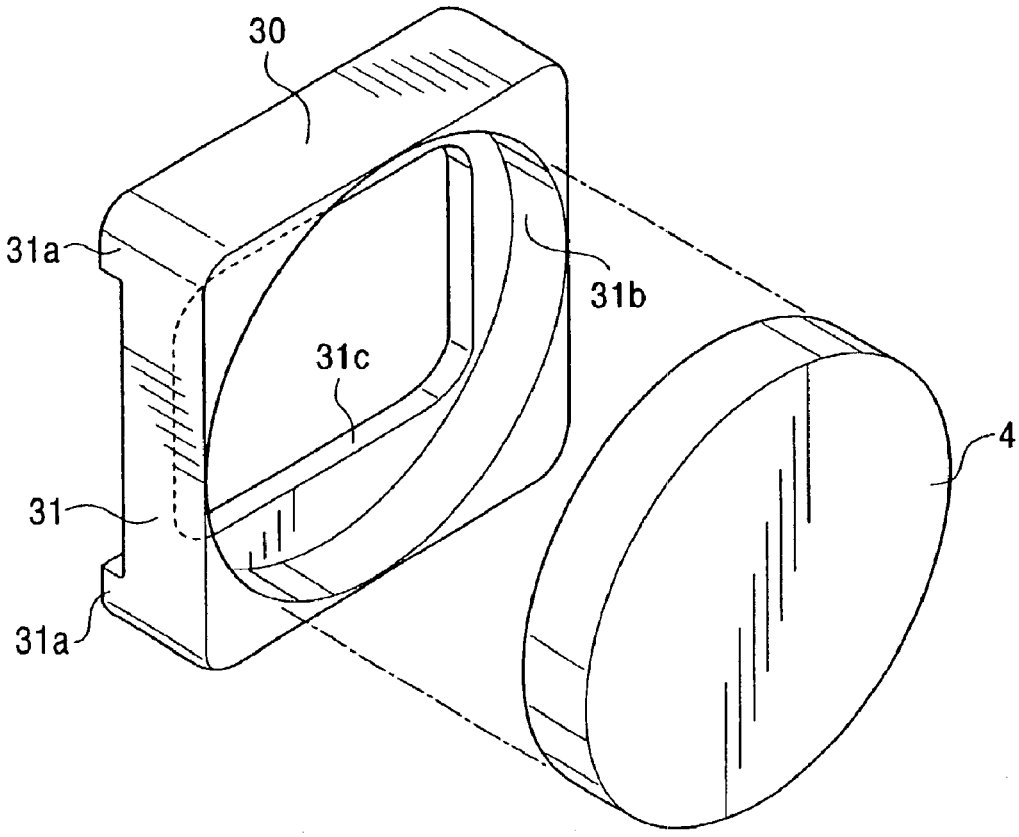
FIG. 6 is a perspective view showing an example of a spacer member included in the isolator.

Further, since the magnetic assembly 15 has a thickness which occupies about half the thickness of the space between the lower yoke 3 and the upper yoke 2 in the space, a spacer member 30, which is also shown in FIG. 6, is accommodated in the space located on the upper yoke 2 side of the magnetic assembly 15, and the magnetic member 4 is disposed in the spacer member 30.

The spacer member 30 is composed of a base portion 31, which has a size capable of being accommodated in the upper yoke 2 and a rectangular plate shape when viewed in a plane, and leg portions 31*a* disposed at the four corners of the base portion 31 on the bottom side of the base portion 31. Further, a circular accommodating recessed portion 31*b* is formed on the surface (upper surface) of the base portion 31 where the leg portions 31*a* . . . are not formed, and a rectangular through-hole 31*c*, which passes through the base portion 31, is formed on the bottom surface side of the accommodating recessed portion 31*b*.

Then, the magnetic member 4 composed of the disk-shaped permanent magnet is fit in the accommodating recessed portion 31*b*. Then, the spacer member 30 provided with the magnetic member 4 is accommodated between the yokes 2 and 3 the state in which the capacitor substrates 11 and 12, the extreme end conductors 6*c* and 7*c* connected thereto as well as the terminating resistor 13 and the extreme end of the extreme end conductor 8*c* connected thereto are pressed against the bottom of the lower yoke 3 by the four leg portions 31*a* of the spacer member 30 so as to press the magnetic assembly 15 against the bottom surface of the lower yoke 3 by the bottom of the spacer member 30.

Note that the first, second, and third line conductors 6, 7, and 8 are pressed against the front surface while applying tension thereto by pressing the extreme end conductors 6*c*, 7*c*, and 8*c* with the four leg portions 31*a* of the spacer member 30 as described above. At the same time, the first, second, and third line conductors 6, 7, and 8 are pressed against the front surface of the magnetic substrate 5 by pressing them with the bottom surface of the spacer member 30, thereby the magnetic assembly 15 is fixed to the bottom of the lower yoke 3.

In the isolator 1 of the embodiment shown in FIGS. 1 to 6, the first and second line conductors 6 and 7 are bent through the plane receiving surfaces 5*d*, 5*d* of the magnetic substrate 5, and the third line conductor 8 is bent along the long side 5*a* of the magnetic substrate 5. Thus, the bending portions of the central conductors 6*b*, 7*b*, and 8*b* of the respective line conductors 6, 7, and 8 are folded on the front surface of the magnetic substrate 5 at an accurate angle of 120° in, for example, the first and second line conductors 6 and 7. That is, since a folding job is executed through the straight line portions of the edges of the plane receiving surfaces 5*d*, the central conductors 6*b* and 7*b* can be easily bent by causing them to intersect each other accurately at the angle of 120° on the front surface of the magnetic substrate 5. Thus, a signal input to the magnetic substrate 5 from the line conductors on an input side can be effectively transmitted to an output side, thereby a low loss and broadband pass characteristics can be exerted. Accordingly, preferable magnetic characteristics can be reliably obtained by the magnetic assembly 15.

Further, the central conductors 6*b*, 7*b*, and 8*b*, which have been folded to the front surface side of the magnetic substrate 5, are overlapped as shown in FIG. 1, and in this overlapped state, the divided conductors 6*b*1, 6*b*2, 7*b*1, 7*b*2, 8*b*1, and 8*b*2, which have been divided into the two portions in the respective central conductors 6*b*, 7*b*, and 8*b*, are overlapped individually. However, in the overlapped portions of these divided conductors 6*b*1, 6*b*2, 7*b*1, 7*b*2, 8*b*1, and 8*b*2, any overlapped portion includes only any two of these divided conductors and three divided conductors are not overlapped in any of the overlapped portions. This is because the overlapping structure is arranged such that each of the two central conductors 6 and 7 is divided into the two portions, and then the central conductor 8*b* is arranged to have such a two-division structure that it is divided into the two portions in the state in which it is broadened out so that a portion where the central conductors 6*b* and 7*b* are overlapped can be prevented.

The overlapping structure as described above can prevent three divided conductors from being overlapped, thereby the overlapped portions of the central conductors 6*b*, 7*b*, and 8*b* can be uniformly pressed when they are pressed against the magnetic substrate 5 with the bottom of the spacer member 30. If there is a portion where three divided conductors, for example, are overlapped, the thickness of the portion where the three divided conductors are overlapped is larger than that of the portion where two divided conductors are overlapped. Thus, a strong press force of the spacer member 30 acts on the portion where the three divided conductors are overlapped, whereas a sufficient press force of the spacer member 30 does not act on the portion where the two divided conductors are overlapped. Accordingly, there is an increasing possibility in that it is difficult to uniformly support all the central conductors 6*a*, 7*b*, and 8*b* by uniformly acting a press force thereon.

Further, as described above, since the divided conductors 8*b*1 and 8*b*2 of the central conductor 8*b* are divided such that they are in parallel or in non-parallel with each other and bent or curved, the signal input from the input side line conductors can be effectively transmitted on the magnetic substrate 5 composed of the high frequency ferrite and output, thereby a wide band passing-through property can be exerted.

Further, an inductance must be increased by increasing the lengths of the respective line conductors 6, 7, and 8 to use them in a relatively low frequency on the order of several hundred megahertzs. In the present invention, the third central conductor 8*b* of the third line conductor 8 is bent (flexed) or curved in a direction where it is separated from each other at the central portion thereof in a length direction or disposed in parallel with each other and bent or curved so as to increase the inductance of the third line conductor 8 by substantially increasing the length of the third line conductor 8, which permits the low frequency to be compatible with the miniaturization.

Next, in this embodiment, the shape of the main body 10A of the electrode 16 is arranged approximately similarly to that of the magnetic substrate 5 when viewed in a plane. With this arrangement, since the main body 10A comes into contact with the lower yoke 3 disposed thereunder in a wide area, a resistance is reduced and a loss can be decreased.

Next, as described above, the recessed portions 18*a*, 19*b*, and 10*e* are formed at the respective bases of the first, second, and third line conductors 6, 7, and 8 so as to slightly increase the lengths of the respective line conductors. Thus, the inductances of the respective central conductors 6, 7, and 8 can be increased and the areas of resonant capacitors can be reduced, in other words, there is an advantage that the areas of the capacitor substrates 11 and 12 can be reduced, which contributes to the miniaturization of the isolator 1 in its entirety.

Figure 7A:
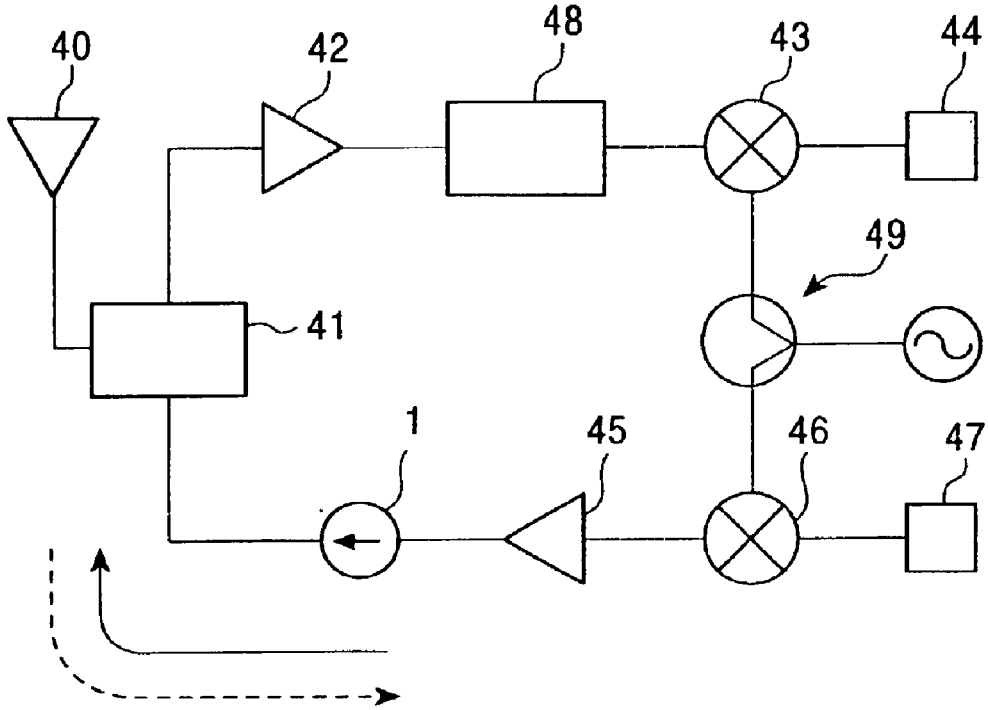
FIG. 7A is a view showing an example of an electric circuit including this type of the isolator.

FIG. 7A shows an example of a circuit arrangement of a mobile phone device into which the isolator 1 of the embodiment is assembled. In the circuit arrangement of this example, an antenna resonator 41 is connected to an antenna 40, a reception circuit 44 is connected to the output of the antenna resonator 41 through a low-noise amplifier 42, a filter 48, and a selection circuit 43, a transmission circuit 47 is connected to the input of the antenna resonator 41 through the isolator 1 of the above embodiment, a power amplifier (amplifier) 45, and a selection circuit 46, and a distribution transformer 49 is connected to the selection circuits 43 and 46.

The isolator 1 arranged as described above is used by being assembled into a circuit of the mobile phone device as shown in FIG. 7A and acts to permit a signal to pass from the isolator 1 to the antenna resonator 41 with a low loss but acts to shut off a signal in an opposite direction by increasing a loss. With this arrangement, there can be achieved such an action that unnecessary signals, for example, noise and the like are prevented from being reversely input to the amplifier 45.

Figure 7B:
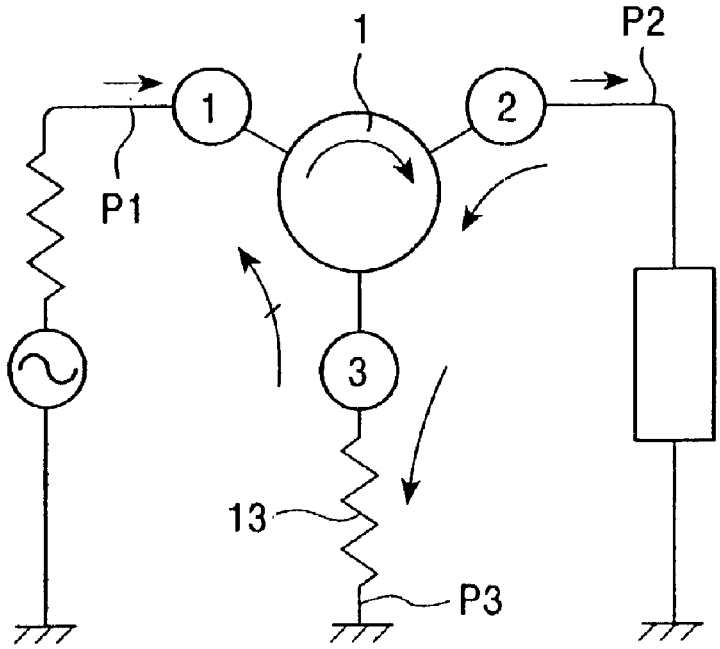
FIG. 7B is a view showing an operation principle of the isolator.

FIG. 7B shows an operation principle of the isolator 1 arranged as shown in FIGS. 1 to 6. The isolator 1 assembled into the circuit shown in FIG. 7B transmits a signal from the first port P1 denoted by reference numeral (1) to the second port 2 denoted by reference numeral (2). However, the isolator 1 attenuates a signal from the second port P2 denoted by reference numeral (2) to the third port P3 denoted by reference numeral (3) through the terminating resistor 13 and absorbs it, and shuts off a signal from the third port P3 denoted by the reference numeral (3) on the terminating resistor 13 side to the first port P1 denoted by reference numeral (1).

Accordingly, the advantage described above can be achieved by assembling the isolator 1 into the circuit shown in FIG. 7A.

Figure 8:
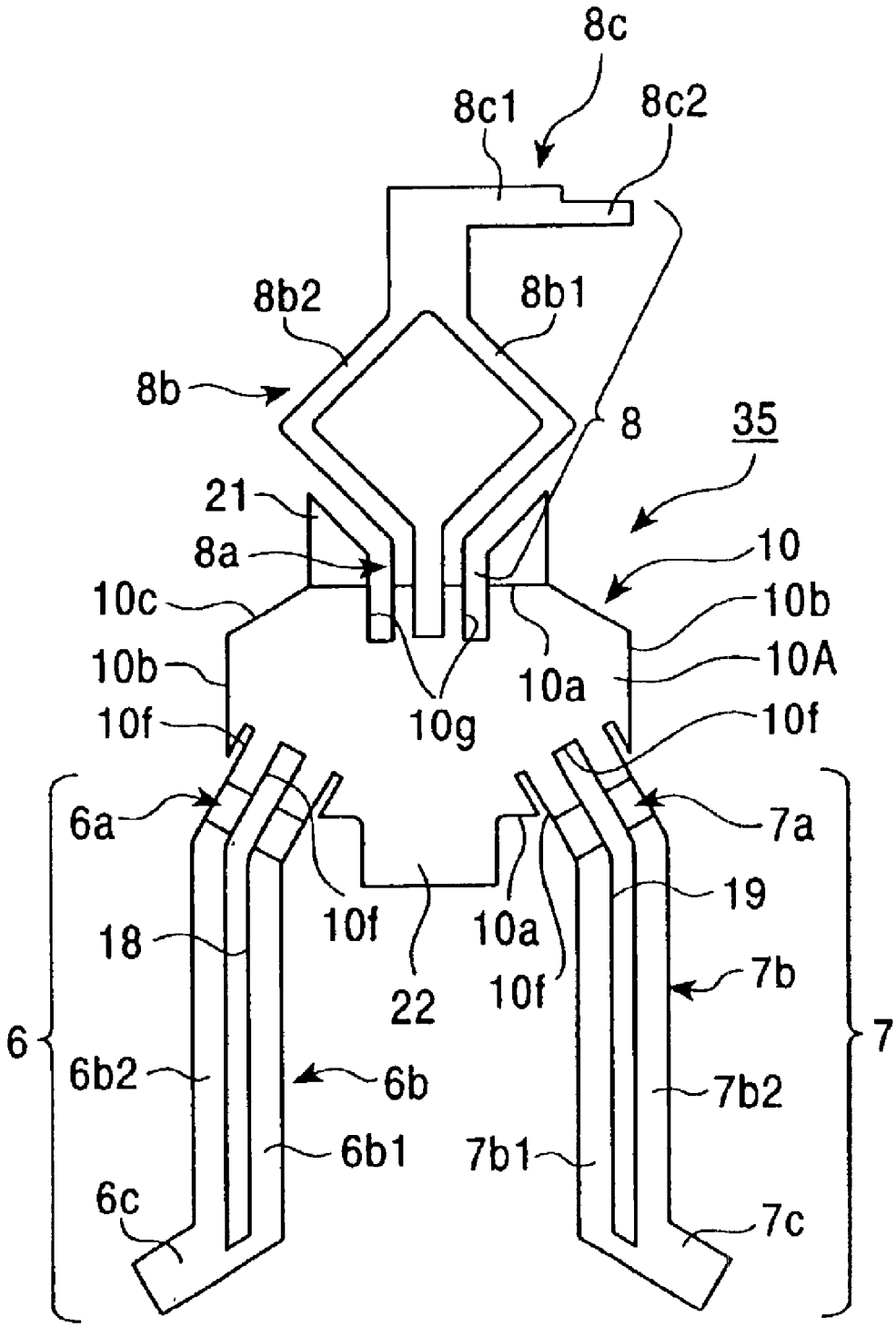
FIG. 8 is a view showing a second example of the electrode of the isolator according to the present invention.

FIG. 8 shows an electrode 35 applied to a nonreciprocal circuit device of a second embodiment according to the present invention. In the electrode 35 of this embodiment, the same components as those of the electrode 16 of the first embodiment are denoted by the same reference numerals, and the description thereof is omitted.

The electrode 35 of the second embodiment is different from the electrode 16 of the first embodiment as its feature in that recessed portions 10*f*, which are approximately as long (deep) as the above base conductor 6*a* are formed in the main body 10A of a common electrode 10 at the bases of the first line conductor 6 and the second line conductor 7 so that the lengths of respective line conductors 6 and 7 are more increased. Further, recessed portions 10*g*, which are as long (deep) as the above recessed portions 10*f*, are also formed at the base of a third line conductor 8 to thereby more increase the length of the third line conductor 8.

As shown in the embodiment of FIG. 8, the structure may be employed which is arranged such that the effective length of the line conductors 6, 7, and 8 are more increased by forming the recessed portions 10*f* and 10*g*, which are deeper than those of the first embodiment, in the main body 10A of the common electrode 10. In this case, insulation layers must be disposed up to the portions where the recessed portions 10*f* and 10*g* are arranged so that the respective line conductors 6, 7, and 8 are individually insulated on the back surface of the magnetic substrate 5. Further, the divided conductors 8*b*1 and 8*b*2 of the line conductor 8 may be disposed in parallel with each other and bent or curved as in an embodiment described later.

The employment of the above structure more increases the inductances of the central conductors 6, 7, and 8, which results in an advantage of increasing the areas of resonant capacitors, in other words, an advantage of reducing the areas of substrates 11 and 12, which contributes to the miniaturization of the isolator 1 in its entirety.

Figure 9:
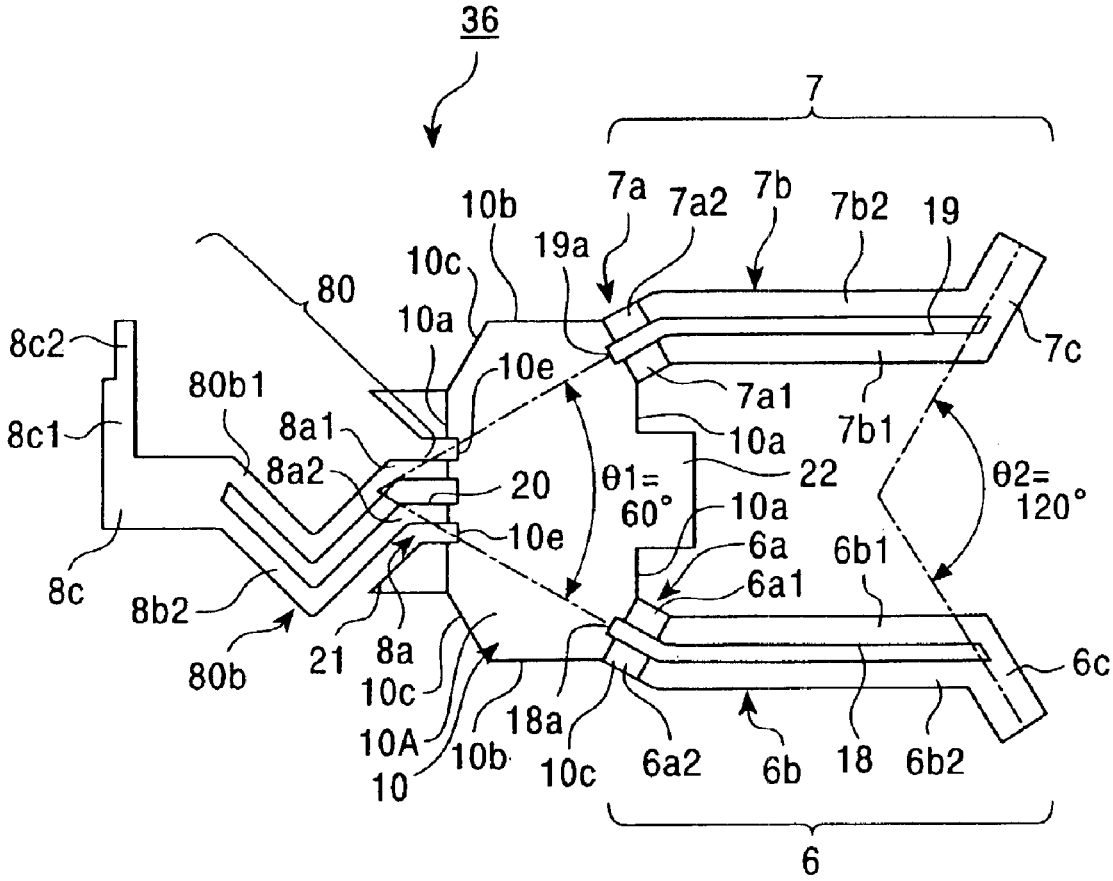
FIG. 9 is a view showing a third example of the electrode of the isolator according to the present invention.

FIG. 9 shows an electrode 36 applied to a nonreciprocal circuit device of a third embodiment according to the present invention. In the electrode 36 of this embodiment, the same components as those of the electrode 16 of the first embodiment are denoted by the same reference numerals, and the description thereof is omitted.

The electrode 36 of the third embodiment is different from the electrode 16 of the first embodiment in that the central conductor 80*b* of a third line conductor 80 is divided into divided conductors 80*b*1 and 8*b*2, and the divided conductor 80*b*1 is bent so as to be in parallel with the divided conductor 8*b*2 in place of being in non-parallel therewith. Accordingly, the third central conductor 80*b* has an L-shape. Note that while it is described that the central conductor 80*b* is arranged in a bent (flexed) state, it is needless to say that a radius may be applied to a curved shape or to a bent portion. Further, the shape of these divided conductors is not limited the L-shape and they may be course arranged in a bent shape such as a zigzag shape and a wave shape.

Even the structure provided with the third line conductor 80 including the divided conductors 80*b*1 and 8*b*2 arranged in the above shape permits the low frequency of the nonreciprocal circuit device to be compatible with the miniaturization thereof by increasing the substantial length of the central conductor 80*b*.

Figure 10:
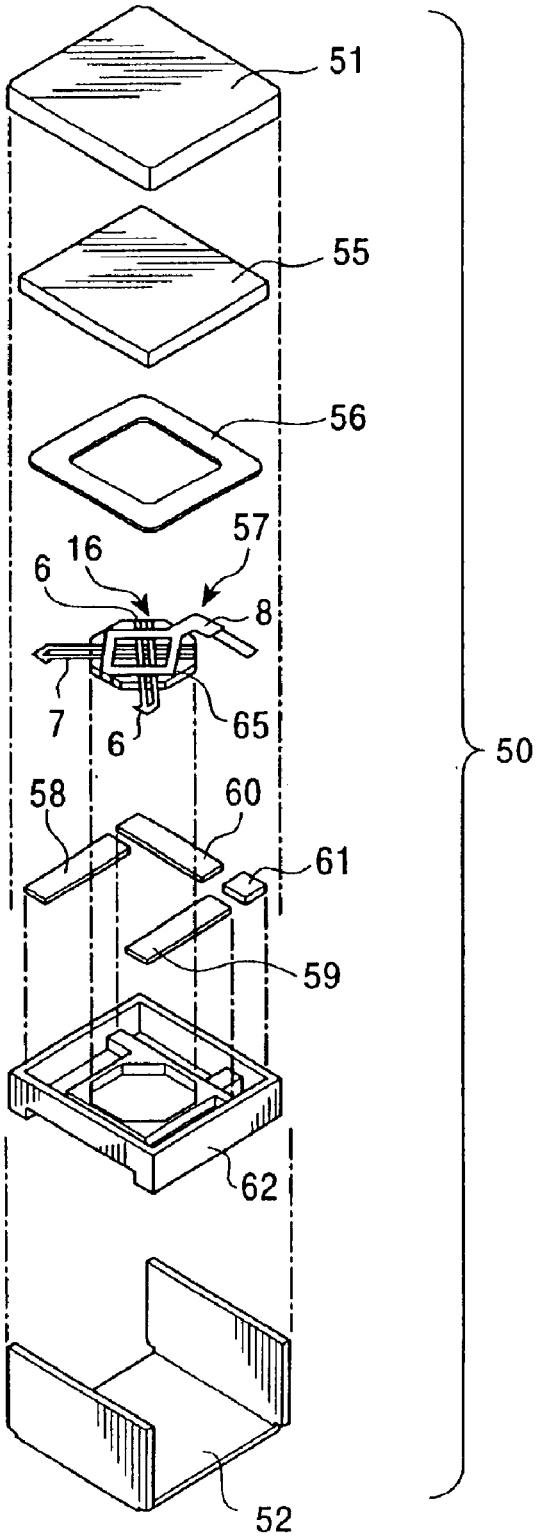
FIG. 10 is an exploded perspective view showing another embodiment of the isolator according to the present invention.

FIG. 10 is shows a fourth embodiment of a nonreciprocal circuit device (isolator) according to the present invention. The isolator 50 of the embodiment is arranged such that a magnet member 55, which is composed of a square plate-shaped permanent magnet, a spacer member 56, a magnetic assembly 57, capacitor plates 58, 59, and 60, a terminating resistor 61, and a resin case 62 for accommodating them are accommodated in a closed magnetic circuit composed of an upper yoke 51 and a lower yoke 52, in other words, between the upper yoke 51 and the lower yoke 52.

The magnetic assembly 57 is arranged such that an electrode 16 similar to the electrode 16 of the first embodiment is wound around a magnetic substrate 65 which has an approximately rectangular shape when viewed in a plane. While the magnetic substrate 65 has a shape approximately similarly to that of the landscape magnetic substrate 5 of the first embodiment, it is arranged in a rectangular shape somewhat near to a square shape.

The isolator 50 having the structure shown in FIG. 10 can obtain an advantage similar to that of the isolator 1 of the first embodiment.

Figure 11:
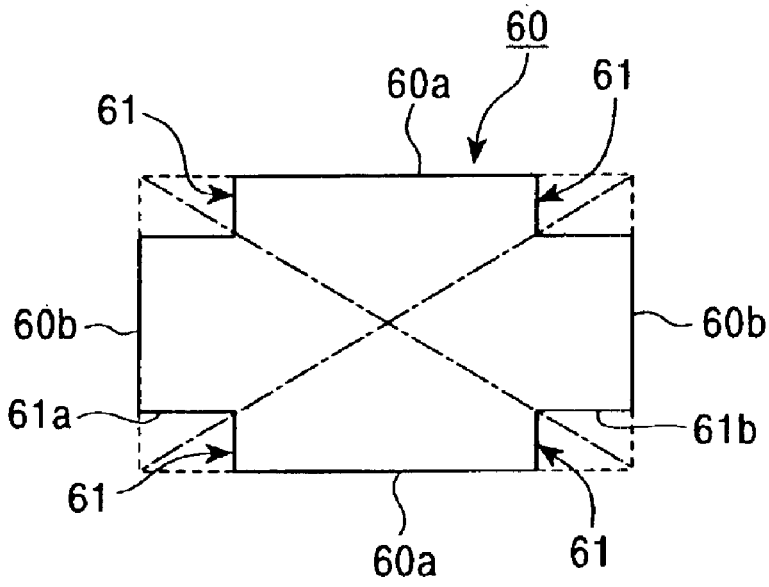
FIG. 11 is a plan view showing another example of the magnetic substrate applied to the isolator according to the present invention.

FIG. 11 shows another example of the magnetic substrate. A magnetic substrate 60 of the example has an approximately rectangular shape when viewed from a plane and L-shaped cut-out receiving portions 61 at the four corners thereof. One of the two planes, which constitute one of receiving portions 61, is arranged as a receiving surface 61*a* for holding back a line conductor 6, one of the two planes, which constitute another one of the receiving portions 61 is arranged as a receiving surface 61*b* for holding back a second line conductor 7, and a first central conductor 6*b* and a second central conductor 7*b* of an electrode 16 are accurately held back by these receiving surfaces 61*a* and 61*b*.

The magnetic substrate 60 of the embodiment also has an approximately landscape rectangular shape when viewed in a plane. In more detail, the magnetic substrate 60, which is arranged in the approximately rectangular shape, when viewed in a plane, is composed of confronting long sides 60*a*, 60*a*, short sides 60*b*, 60*b*, which extend in a direction perpendicular to the long sides, and two sides constituting the receiving portions 61 described above.

An advantage similar to that of the first embodiment can be also obtained by using the magnetic substrate 60.

Figure 12:
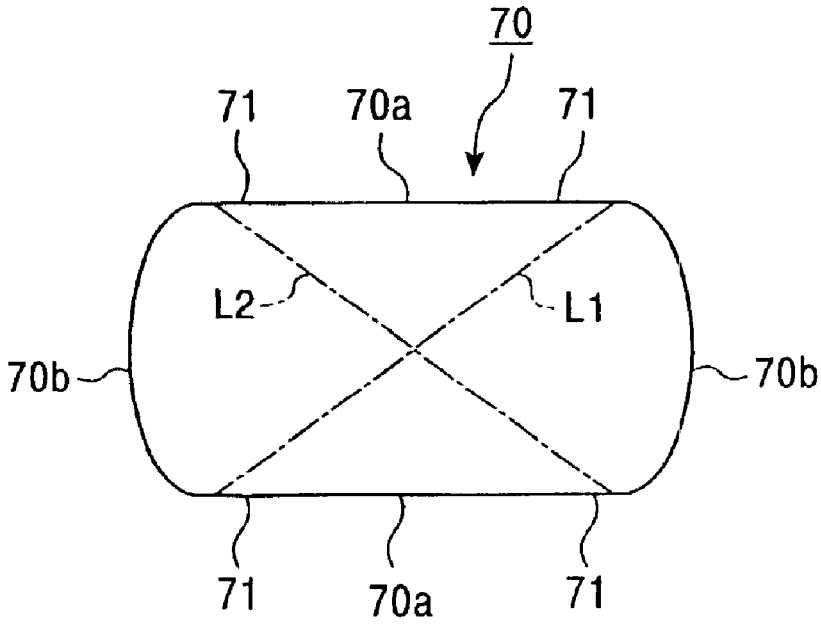
FIG. 12 is a plan view showing still another example of the magnetic substrate applied to the isolator according to the present invention.
Figure 13:
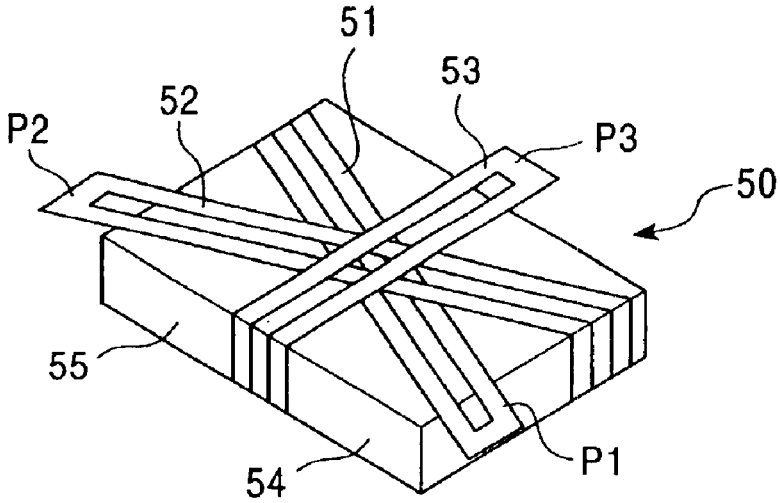
FIG. 13 PRIOR ART
FIG. 13 is a perspective view showing an example of a conventional magnetic assembly.
Figure 14:
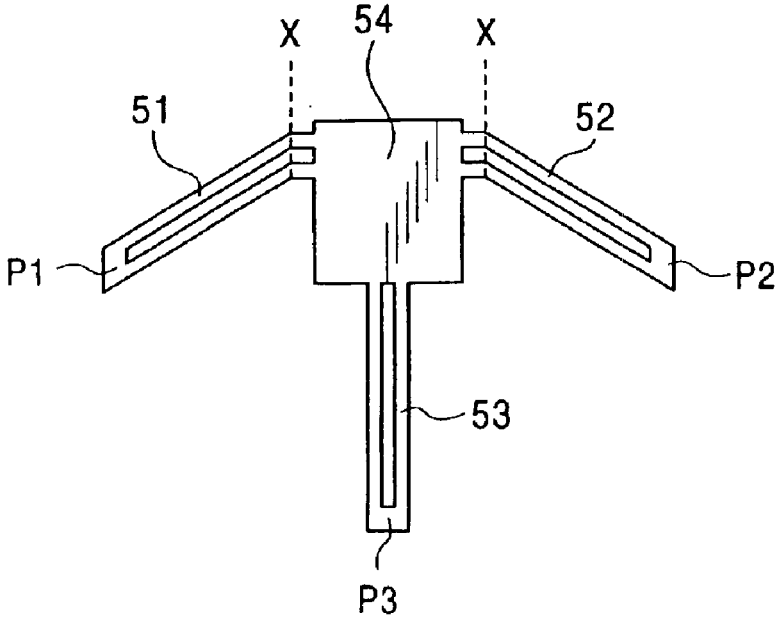
FIG. 14 PRIOR ART
FIG. 14 is a developed view of an electrode applied to the conventional magnetic assembly.

FIG. 12 shows still another example of the magnetic substrate. A magnetic substrate 70 of the example has an approximately rectangular race-track shape having curved short sides when viewed from a plane and flat receiving portions 71 at the four corners thereof. This shape is also included in the concept of the approximately rectangular shape in the present invention. In more detail, the magnetic substrate 70 is composed of confronting long sides 70*a*, 70*a*, and elliptically-arc-shaped short sides 70*b*, 70*b* for connecting the ends of these long sides 70*a*, 70*a* with each other so that the first, second, and third central conductors 6*b*, 7*b*, and 8*b* of the electrode 16 described above can be accurately bent back by plane receiving portions 71, 71 disposed at the ends of the long sides 70*a*, 70*a* and by the long sides 70.

An advantage similar to that of the first embodiment can be also obtained by using the magnetic substrate 70.

As described above, in the present invention, since the first and second central conductors are bent and wound from one surface to the other surface of the magnetic substrate, which is arranged as a substantially rectangular shape when viewed in a plane through the receiving surfaces thereof, the central conductors can be wound to the other surface of the magnetic substrate by being reliably bent at accurate positions through the edges of the receiving surfaces. As a result, the central conductors can be disposed to the magnetic substrate at reliable positions. That is, as a result of bending the central conductors through the edges of the receiving surfaces, a deformation caused when the central conductors are bent is suppressed, thereby the respective central conductors can be bent with respect to the magnetic substrate at predetermined angles.

Accordingly, since the nonreciprocal circuit device having excellent characteristics and stable and high quality is obtained, thereby the productivity of an assembling job for assembling the nonreciprocal circuit device having the magnetic assembly is improved.

Further, in the present invention, when the capacitor substrates are disposed on both the sides of the magnetic substrate, which is arranged as a substantially rectangular shape when viewed in a plane, along the longer direction thereof, they can be disposed on both the sides of the magnetic substrate in a good settlement. As a result, the nonreciprocal circuit device including the magnetic substrate and the capacitor substrates can be miniaturized in its entirety.

Further, in the present invention, the lengths of the line conductors can be increased by forming the recessed portions by cutting the peripheral edge of the common electrode at the positions thereof corresponding to the bases of the line conductors. The inductances of the line conductors are increased by the increase in the conductor lengths of the line conductors to thereby relatively reduce the resonant capacitance of the capacitor substrates, which contributes to the low frequency and the miniaturization of the nonreciprocal circuit device by reducing the sizes of the capacitor substrates. Further, the area of the magnetic substrate can be reduced when the same inductance is secured, which also contributes to the miniaturization of the nonreciprocal circuit device in its entirety.

In the present invention, when the portions, where the divided conductors are overlapped each other, are dislocated when viewed in a plane, the divided conductors can be uniformly disposed on the other surface of the magnetic substrate in a good settlement when viewed in a plane. Further, when the all the portions, where the divided conductors of the first line conductor, the second line conductor, and the third line conductor are overlapped, are dislocated when viewed in a plane, there is not any portion where three divided conductors are overlapped. Thus, the occurrence of irregularities, which are caused by the occurrence of portions where two divided conductors are overlapped and portions where three divided conductors are overlapped, is reduced, thereby irregularities on the other surface of the magnetic substrate are reduced.

In the present invention, a large capacitance can be obtained by occupying a small area by the capacitors by arranging at least one of the capacitor substrates as the common capacitor substrate connected to the plurality of line conductors, which contributes to the miniaturization of the nonreciprocal circuit device.

What is claimed is:

1. A nonreciprocal circuit device comprising:

a magnetic substrate which has a substantially rectangular shape, when viewed in a plane;

a plate-shaped common electrode disposed on one surface of the magnetic substrate;

a first line conductor, a second line conductor, and a third line conductor extending from an outer periphery of the common electrode in three directions;

a first central conductor disposed to the first line conductor and bent to the other surface side of the magnetic substrate;

a second central conductor disposed to the second line conductor and bent to the other surface side of the magnetic substrate; and a third central conductor disposed to the third line conductor and bent to the other surface side of the magnetic substrate, wherein capacitor substrates connected to the first, second and third line conductors are disposed along two edges of the magnetic substrate in a longer direction thereof, when viewed in a plane.

2. A nonreciprocal circuit device according to claim 1, wherein at least one of the capacitor substrates is arranged as a common capacitor substrate connected to the plurality of line conductors.

3. A nonreciprocal circuit device, comprising:

a magnetic substrate which has a substantially rectangular shape, when viewed in a plane;

a plate-shaped common electrode disposed on one surface of the magnetic substrate;

a first line conductor, a second line conductor, and a third line conductor extending from an outer periphery of the common electrode in three directions;

a first central conductor disposed to the first line conductor and bent to the other surface side of the magnetic substrate;

a second central conductor disposed to the second line conductor and bent to the other surface side of the magnetic substrate;

a third central conductor disposed to the third line conductor and bent to the other surface side of the magnetic substrate; and capacitor substrates acting as matching capacitors in the first to third central conductors, wherein receiving surfaces for bending the respective central conductors are formed at the respective ends of the two confronting sides of the magnetic substrate, and the first central conductor and the second central conductor are bent to the other surface side of the magnetic substrate through the receiving surfaces of the magnetic substrate as well as disposed along diagonal lines of the magnetic substrate on the other surface thereof; and recessed portions are formed on both the sides of at least one of a portion where the first line conductor is connected to the common electrode, a portion where the second line conductor is connected to the common electrode, and a portion where the third line conductor is connected to the common electrode by cutting a peripheral edge of the common electrode so that a length of at least one of the line conductors extends.

4. A nonreciprocal circuit device according to claim 3, wherein slits are formed at a center of the first line conductor in a width direction thereof and at a center of the second line conductor in a width direction thereof along length directions thereof so that each of the first line conductor and the second line conductor are divided into two divided conductors.

5. A nonreciprocal circuit device according to claim 4, wherein the divided conductors are bent to the other surface side of the magnetic substrate and overlapped on the other surface of the common electrode, and portions where the respective divided conductors are overlapped are dislocated on the other surface of the common electrode when viewed in a plane.

6. A nonreciprocal circuit device according to claim 5, wherein the third central conductor is overlapped on the first central conductor and the second central conductor on the other surface of the magnetic substrate, when viewed in a plane, and all the portions where the third central conductor is overlapped on the first central conductor and the second central conductor are dislocated when viewed in a plane.

7. A nonreciprocal circuit device according to claim 3, wherein the third central conductor is one of bent and curved so as to intersect the first central conductor and the second central conductor and to be overlapped thereon, when viewed in a plane, on the other surface of the magnetic substrate and is divided into two divided conductors which include non-parallel portions.

8. A nonreciprocal circuit device according to claim 3, wherein the third central conductor is one of bent and curved so as to intersect the first central conductor and the second central conductor and to be overlapped thereon, when viewed in a plane, on the other surface of the magnetic substrate and divided into two divided conductors which are bent or curved in a parallel state.

9. A nonreciprocal circuit device according to claim 3, wherein capacitor substrates connected to the first, second and third line conductors are disposed on both the sides of the magnetic substrate which has a substantially rectangular shape, when viewed in a plane, in a width direction thereof along a longer direction thereof.

10. A nonreciprocal circuit device according to claim 9, wherein at least one of the capacitor substrates is arranged as a common capacitor substrate connected to the plurality of line conductors.

11. A nonreciprocal circuit device according to claim 3, wherein the common electrode has a shape partitioned by two confronting sides and at least one side connecting the respective ends of the two sides and disposed on the one surface of the magnetic substrate with at least a portion of a peripheral edge thereof disposed along a peripheral edge of the magnetic substrate.

12. A nonreciprocal circuit device according to claim 11, wherein the common electrode has an approximately rectangular shape, when viewed in a plane, having slant side portions at the respective ends of the two confronting sides and has such a size as to be disposed on the one surface of the magnetic substrate with a peripheral edge thereof disposed along a peripheral edge of the magnetic substrate.

13. A nonreciprocal circuit device according to claim 3, wherein the magnetic substrate has an approximately rectangular shape when viewed in a plane, including slant receiving surfaces at the respective ends of the two confronting sides.

* * * * *